US009183997B2

(12) United States Patent
Fangmann et al.

(10) Patent No.: US 9,183,997 B2
(45) Date of Patent: Nov. 10, 2015

(54) SWITCH FOR AN ELECTRIC DEVICE

(71) Applicant: Johnson Electric S.A., Murten (CH)

(72) Inventors: Gerhard Fangmann, Marienheide (DE); Martin Koepsell, Ennepetal (DE)

(73) Assignee: JOHNSON ELECTRIC S.A., Murten (CH)

( * ) Notice: Subject to any disclaimer, the term of this patent is extended or adjusted under 35 U.S.C. 154(b) by 198 days.

(21) Appl. No.: 13/873,032

(22) Filed: Apr. 29, 2013

(65) Prior Publication Data

US 2013/0284574 A1 Oct. 31, 2013

(30) Foreign Application Priority Data

Apr. 28, 2012 (DE) ..... 10 2012 008 684

(51) Int. Cl.

| | |
|---|---|
| ***H01H 36/00*** | (2006.01) |
| ***H01H 13/52*** | (2006.01) |
| ***H01H 5/02*** | (2006.01) |
| ***H01H 3/50*** | (2006.01) |

(52) U.S. Cl.

CPC . *H01H 5/02* (2013.01); *H01H 3/50* (2013.01); *H01H 13/52* (2013.01); *H01H 2003/506* (2013.01)

(58) Field of Classification Search

CPC .. H01H 36/008; H01H 36/00; H01H 36/0073
USPC ..... 200/404, 539, 472, 548, 556, 565, 291, 200/415, 430, 471; 335/207, 205, 306
See application file for complete search history.

(56) References Cited

U.S. PATENT DOCUMENTS

| | | | | |
|---|---|---|---|---|
| 3,984,797 | A * | 10/1976 | Rayburn | 335/306 |
| 4,489,297 | A * | 12/1984 | Haydon et al. | 335/207 |
| 2009/0201110 | A1 * | 8/2009 | Yamada et al. | 335/205 |

* cited by examiner

*Primary Examiner* — Renee S Luebke
*Assistant Examiner* — Ahmed Saeed
(74) *Attorney, Agent, or Firm* — Muncy, Geissler, Olds & Lowe, P.C.

(57) ABSTRACT

A switch has a housing and an actuating element retained on a travel path in the housing. A restoring member (4) provides a restoring force urging the actuator to an off position at one end of the travel path. A resistance generator provides a resistance force which opposes the restoring force when the actuator is in a fully actuated position to reduce the holding force require to keep the actuating element in the fully actuated position.

19 Claims, 7 Drawing Sheets

SWITCH FOR AN ELECTRIC DEVICE

CROSS REFERENCE TO RELATED APPLICATIONS

This non-provisional patent application claims priority under 35 U.S.C. §119(a) from Patent Application No. 10 2012 008 684.9 filed in Germany on Apr. 28, 2012.

FIELD OF THE INVENTION

The invention relates to a switch for an electrical device, the switch housing of which accommodates at least one actuating element retained in a travel path and at least one restoring member that engages with the actuating element.

BACKGROUND OF THE INVENTION

Electrical devices that are equipped with switches of such kind are particularly manual devices that for safety reasons should only be operable by a person who is qualified to operate such manual devices. The restoring member limits the operating times to the period for which the actuating element is operated, the restoring member normally being recessed in a handle structure that a human hand is able to grasp. However, longer operating times have proven problematic, because the restoring force that has to be overcome with a triggering force on the actuating element to achieve this causes cramping of the hand muscles. Cramping of the hand muscles prevents the person who is operating the manual device from using it steadily and precisely. Certain locking mechanisms, by which the actuating element is locked in a switched position that assures operation of the electrical device, offer a degree of assistance. However, such locking mechanisms harbour risks of injury, which regularly result in operators hurting themselves on the tools of the manual devices.

Simply reducing the strength of the restoring force leads to unreliable turning off of the switch and greatly increases the risk of accidental operation of the switch due to bumps and vibrations.

SUMMARY OF THE INVENTION

Hence there is a desire for a switch of the species described above that enables continuous operation while causing low stress to the hand muscles.

The switch according to the invention differs from other such devices in that a resistance generator is attached to the actuating element, and that the magnitude of forces acting on the actuating member in the travel path direction, comprising the restoring force of the restoring member and the resistive force of the resistance generator, varies depending on the position of the actuating member along the travel path.

The inherent switching haptics of the switch according to the present invention may be modified particularly effectively by appropriate dimensioning of the resistive force generated by the resistance generator in terms of magnitude and alignment, within the limits of the ratio of forces subject to the sum of forces. In particular, the modifiable switching haptics enables continuous operation of handheld devices that exerts a low load on the muscles of the human hand. Locking mechanisms that are associated with risk of accidents may be dispensed with entirely. The modified switching haptics is thus based on the sum of forces that is variable over the travel path, so that an actuating force that is to be applied to the actuating element to overcome this sum of forces follows a curved characteristic line when plotted against the travel path. For better handling of electrical devices, it is important to form the characteristic line in such manner that the haptic acquisition of certain switching operations is improved.

According to a subsequent refinement of the invention, the counter bearing of the resistance generator is created in the middle of the course of the travel path. Counter bearings that are positioned in the middle of the travel path are particularly suitable for creating switching levels, which in turn are useful for creating a haptic separation of different operating states. Of course the scope of this invention still applies if the magnetic field generator has counter bearings at located at several section points along the travel path according to the number of operating states that are switchable with the switch. In this context, the counter bearings may be arranged either with a space between them or they may be positioned such that some or all of them overlap each other.

Accordingly, in one aspect thereof, the present invention provides a switch for an electrical device, comprising: the switch housing accommodating at least one actuating element retained on a travel path in the switch housing, and movable between an off position at a first end and a second end of the travel path; at least one restoring member providing a restoring force urging the actuating element to the off position, and a resistance generator attached to the actuating element and retained between at least one resistance bearing formed on the travel path of the switch housing and at least one floating bearing formed on the actuating element, the resistance generator providing a resistive force, wherein the sum of the forces in the direction of the travel path resulting from the restoring force of the restoring member and the resistive force of the resistance generator urging the actuating element to the off position is less when the actuating element is at a selected operational position than when the actuating element is at the off position.

Preferably, the counter bearing of the resistance generator is formed on at least one of the travel path ends.

According to a subsequent refinement of the invention, the counter bearing of the resistance generator is created in the middle of the course of the travel path. Counter bearings that are positioned in the middle of the travel path are particularly suitable for creating switching levels, which in turn are useful for creating a haptic separation of different operating states. Of course the scope of this invention still applies if the magnetic field generator has counter bearings at located at several section points along the travel path according to the number of operating states that are switchable with the switch. In this context, the counter bearings may be arranged either with a space between them or they may be positioned such that some or all of them overlap each other.

Preferably, the resistance generator has counter bearings located at several selected points along the travel path.

Preferably, the resistance generator is furnished with ferromagnetic bodies, at least one being arranged on the counter bearing and at least one on the floating bearing, wherein at least one of the ferromagnetic bodies is a magnet. The magnet may be a permanent magnet or an electromagnet, and may be a component of the counter bearing as well as a component of the floating bearing. The ferromagnetic bodies that cooperate in a resistance generator may have contact or sliding surfaces that are in contact with one another as well as operative surfaces that pass over each other without touching depending on the desired switching haptics. Because of their inherent force characteristics, magnets are particularly well suited from the point of view of haptics to conveying signals that have emotional effects on a person operating a switch according to the invention. With regard to switching operations, emotions induced with signals of such kind are associated for example with Values such as "full", "spongy", "brief", "fleeting" or "continuous".

Preferably, both ferromagnetic bodies are a magnet. This creates a particularly powerful resistance generator.

Preferably, the magnets are arranged with their opposite poles facing towards each other.

In this case, the magnitude of the force acting on the actuating member in the direction of the travel path arising from the restoring force of the restoring member and the magnetic force of the ferromagnetic bodies varies depending on the position of the actuating member along the travel path. The magnetic force should be smaller than the restoring force to prevent latching. The arrangement of opposite poles facing towards each other is provided particularly in order to create switch positions that, as a result of the reduced sum of forces and thus also the lower actuating force requirement, are suitable for continuous operation that is gentle on the muscles of the hand.

Alternatively, the magnets are arranged with their like poles facing towards each other, in this case, the sum of the restoring force of the restoring member and the magnetic force of the ferromagnetic bodies in the direction of the travel path also varies depending on the position of the actuating member. The arrangement of like poles facing towards each other is suitable for creating a wear-free limitation of individual switch positions, located on the travel path, for example.

Preferably, the resistance generator has at least one detent structure formed on the resistance bearing and at least one detent structure formed on the floating bearing, wherein at least one of the detent structures comprises a resilient mounting. The resilient mounting may be produced using, torsion springs, leaf springs, tension springs or gas springs. The detent structures that cooperate in a resistance generator may include both sliding surfaces that slide across one another and running surfaces that roll across one another depending on the desired switching haptics.

According to a second aspect, the present invention provides a switch for an electrical device, comprising: a switch housing; an actuating element retained on a travel path within the switch housing and movable between an off position and a fully actuated position; a restoring member providing a restoring force that resiliently urges the actuating element to the off position, and a resistance generator comprising a first magnet fixed with respect to the switch housing and a second magnet fixed with respect to the actuating element, wherein the first magnet and the second magnet are spaced in a direction perpendicular to the travel path with like poles facing towards each other and arranged such that movement of the actuating element from the off position to the fully actuated position causes the second magnet to move passed the first magnet in the direction of the travel path.

Preferably, the first and second magnets generate a repulsive force and a component of the repulsive force in the direction of the travel path reinforces the restoring force when the actuating member is in the off position and opposes the restoring force when the actuating member is in the fully actuated position.

Preferably, at least one third magnet is arranged to provide a preferred position having reduced holding force requirement between the off position and the fully actuated position.

Preferably, the or each third magnet is fixed with respect to the switch housing and is arranged with like poles facing the second magnet.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
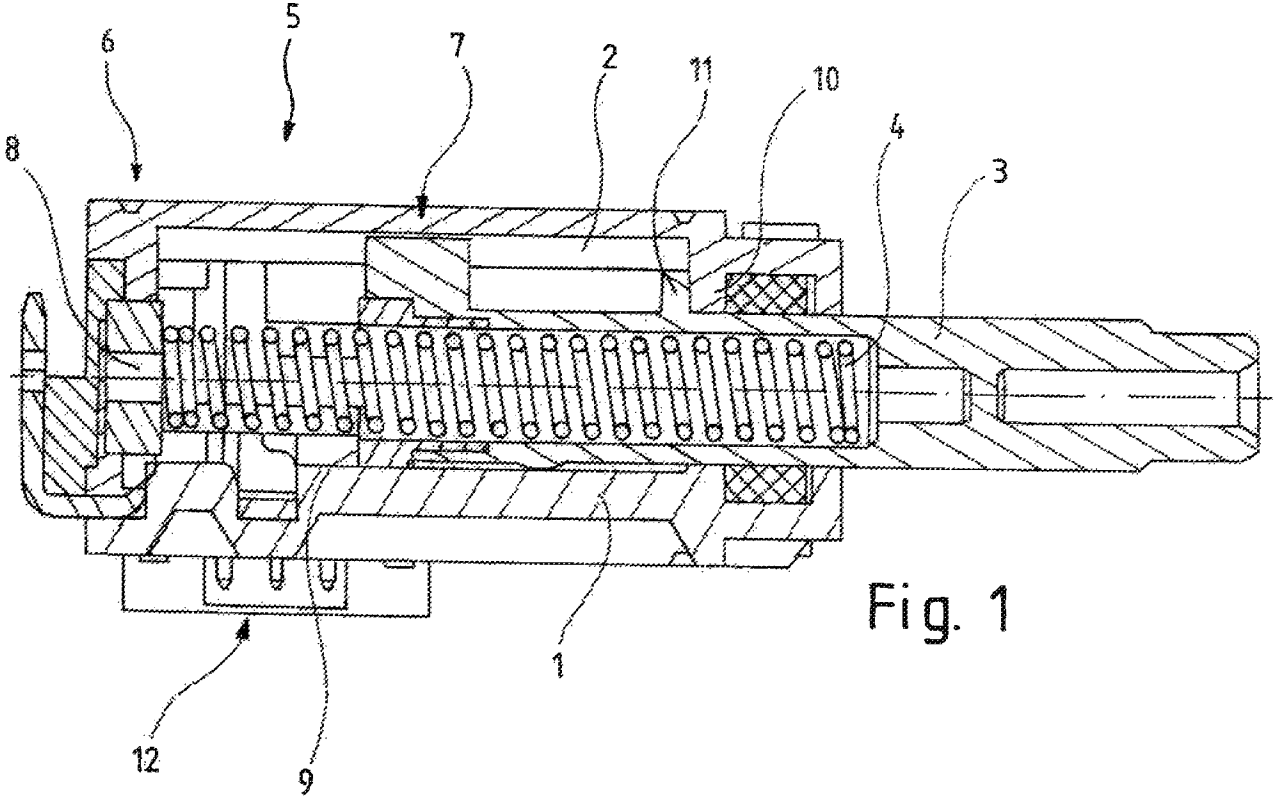
FIG. 1 shows a lengthwise section through a first embodiment of a switch according to the present invention in an unactuated end position of the switch.

FIG. 1 shows the first embodiment of the switch according to the present invention in an unactuated end position of the switch. An actuating element 3 that is retained on a travel path 2 and a restoring member 4 in the form of a helical compression spring that engages with actuating element 3 are arranged inside switch housing 1 of the switch. A resistance generator 5 is attached to actuating element 3 and held between a counter bearing 6 on travel path 2 of switch housing 1 and a floating bearing 7 formed on actuating element 3. The sum of forces in direction of travel 2 resulting from the restoring force of restoring member 4 combined with the resistive force of resistance generator 5 is aligned with the restoring force of restoring member 4. Counter bearing 6 of resistance generator 5 is formed on one of the path ends that limit the length of travel path 2. Resistance generator 5 is furnished with one ferromagnetic body 8, 9 on each of counter bearing 6 and floating bearing 7, wherein both ferromagnetic bodies 8, 9 are in the form of magnets and arranged with their opposite poles facing each other. Switch housing 1 has a stop structure 10, which in the switch end position shown is lying flush against a stop structure 11 formed on actuating element 3. An electrical connecting structure 12 integrated in switch housing 1 connects the switch according to the invention to an electrical device that is not shown in the figure.

Figure 2:
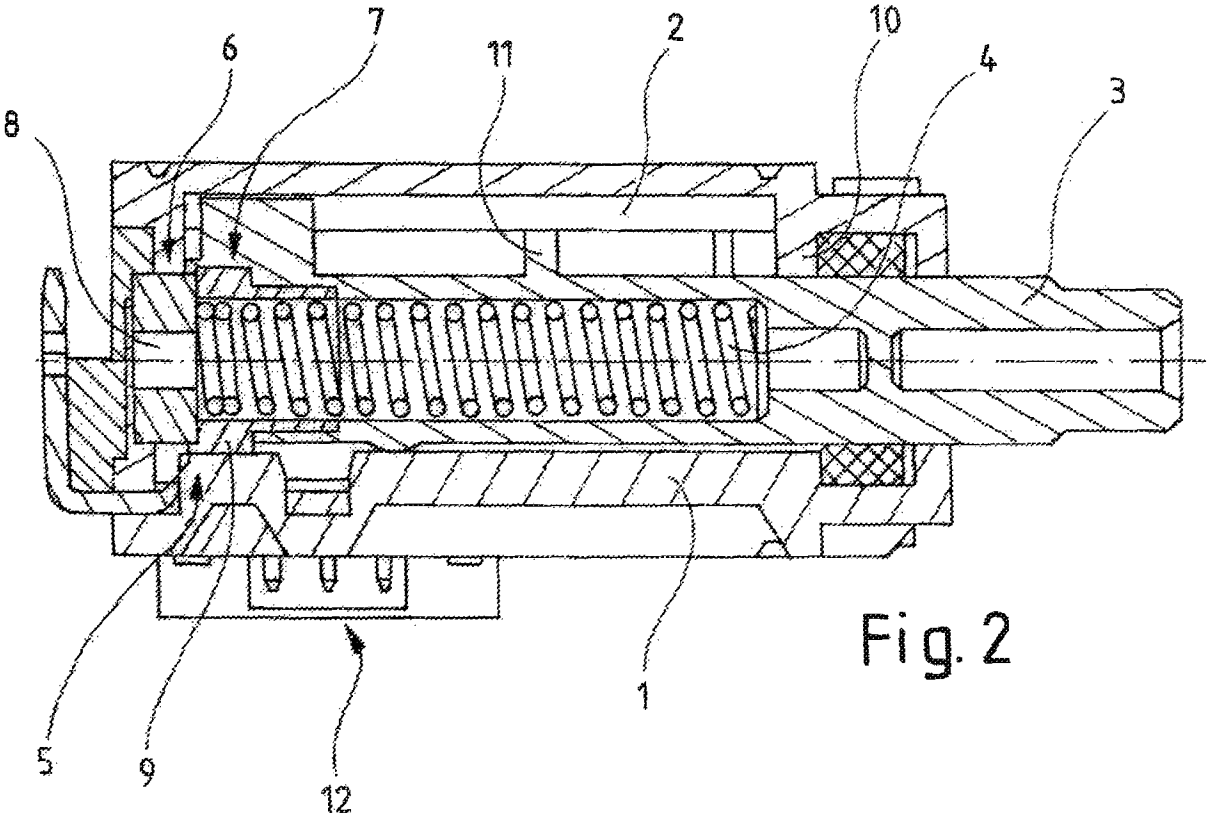
FIG. 2 shows a lengthwise section through the switch of FIG. 1 in an actuated end position of the switch.

FIG. 2 shows the switch according to FIG. 1 in an actuated switch end position, in which ferromagnetic body 8 of counter bearing 6 and ferromagnetic body 9 of floating bearing 7 are touching one another. The same components are identified using the same reference numbers.

Figure 3:
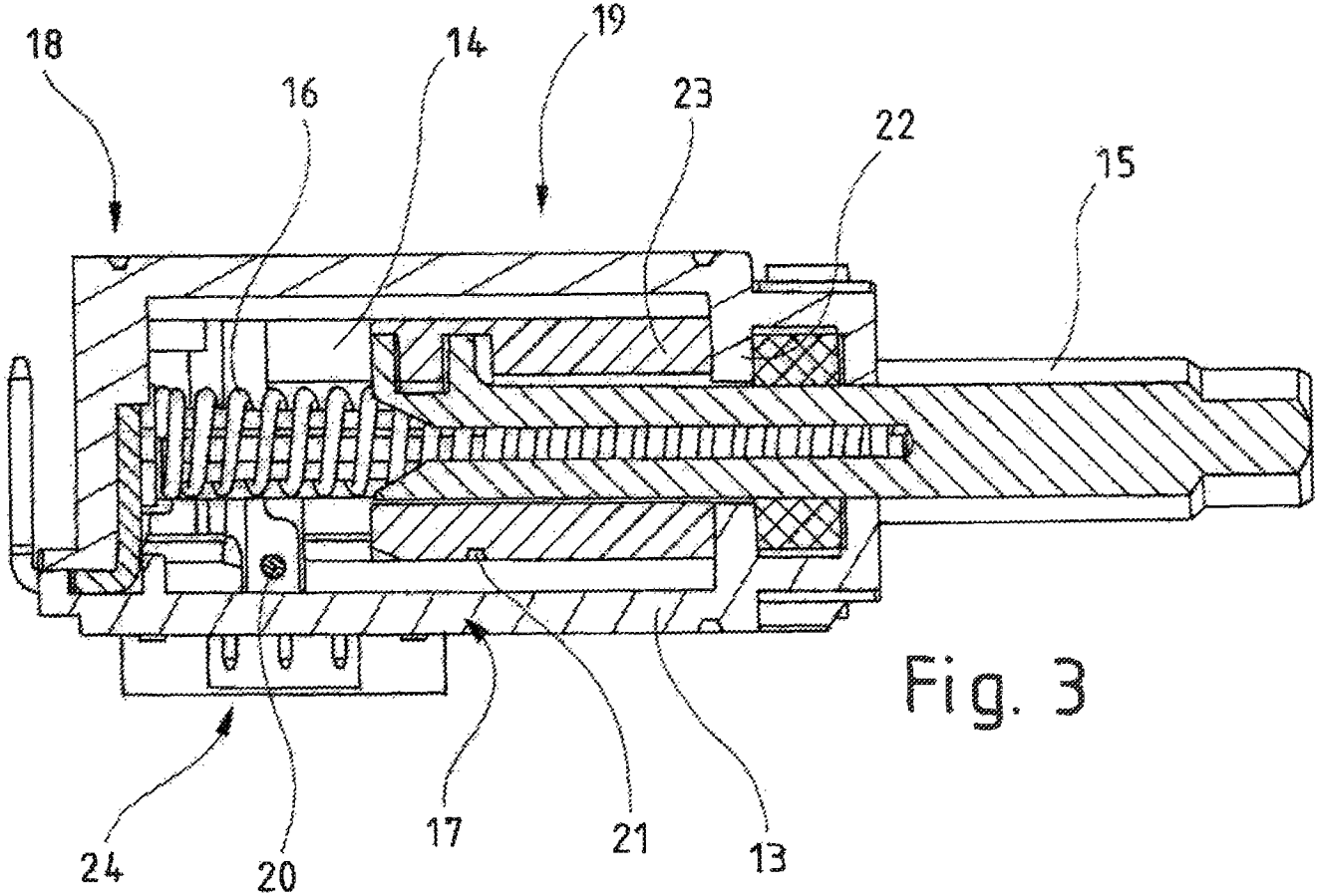
FIG. 3 shows a lengthwise section through a second embodiment of a switch according to the present invention in an unactuated end position of the switch.

FIG. 3 shows the second embodiment of the switch according to the invention in an unactuated switch end position. An actuating element 15 retained on a travel path 14 and a restoring member 16 that engages with actuating element 15 are arranged in switch housing 13 of the switch, the restoring member also having the form of a helical compression spring.

A resistance generator 17 is attached to actuating element 15 and is held between as resistance bearing 18 formed on travel path 14 of switch housing 13 and a floating bearing 19 formed on actuating element 15. The sum of forces in the direction of travel path 14 resulting from the restoring force of restoring member 16 and the resistive force of resistance generator 17 is aligned with the restoring force of restoring member 16. Counter bearing 18 of resistance generator 17 is also formed on one of the path ends that limit the length of travel path 14. Resistance generator 17 is furnished with a detent structure 20 formed on counter bearing 18 and a detent structure 21 formed on floating bearing 19, wherein the detent structure 20 formed on counter bearing 18 is realised as a resilient wire and the detent structure 21 formed on floating bearing 19 has the form of a recess that is in operative connection with the wire. Switch housing 13 has a stop structure 22 which in the switch end position shown is lying flush against a stop structure 23 formed on actuating element 15. An electrical connecting structure that is integrated in switch housing 13 serves to connect switch 13 according to the invention with an electrical device.

Figure 4:
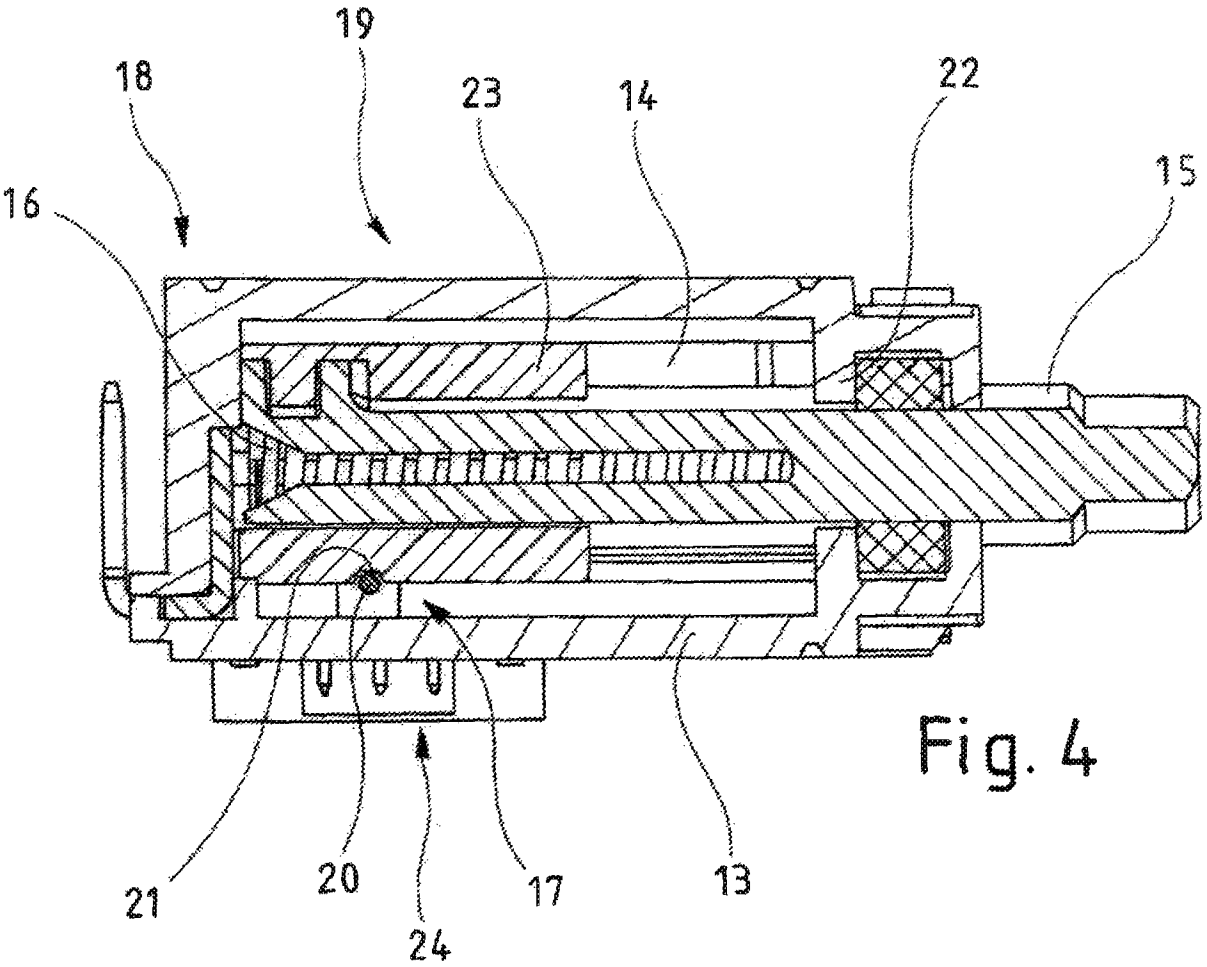
FIG. 4 shows a lengthwise section through the switch of FIG. 3 in an actuated end position of the switch.

FIG. 4 shows the switch according to FIG. 3 in an actuated switch end position, in which detent structure 20 of counter bearing 18 and detent structure 21 of floating bearing 19 are in engaged connection with one another. The same components are identified using the same reference numbers.

Figure 5:
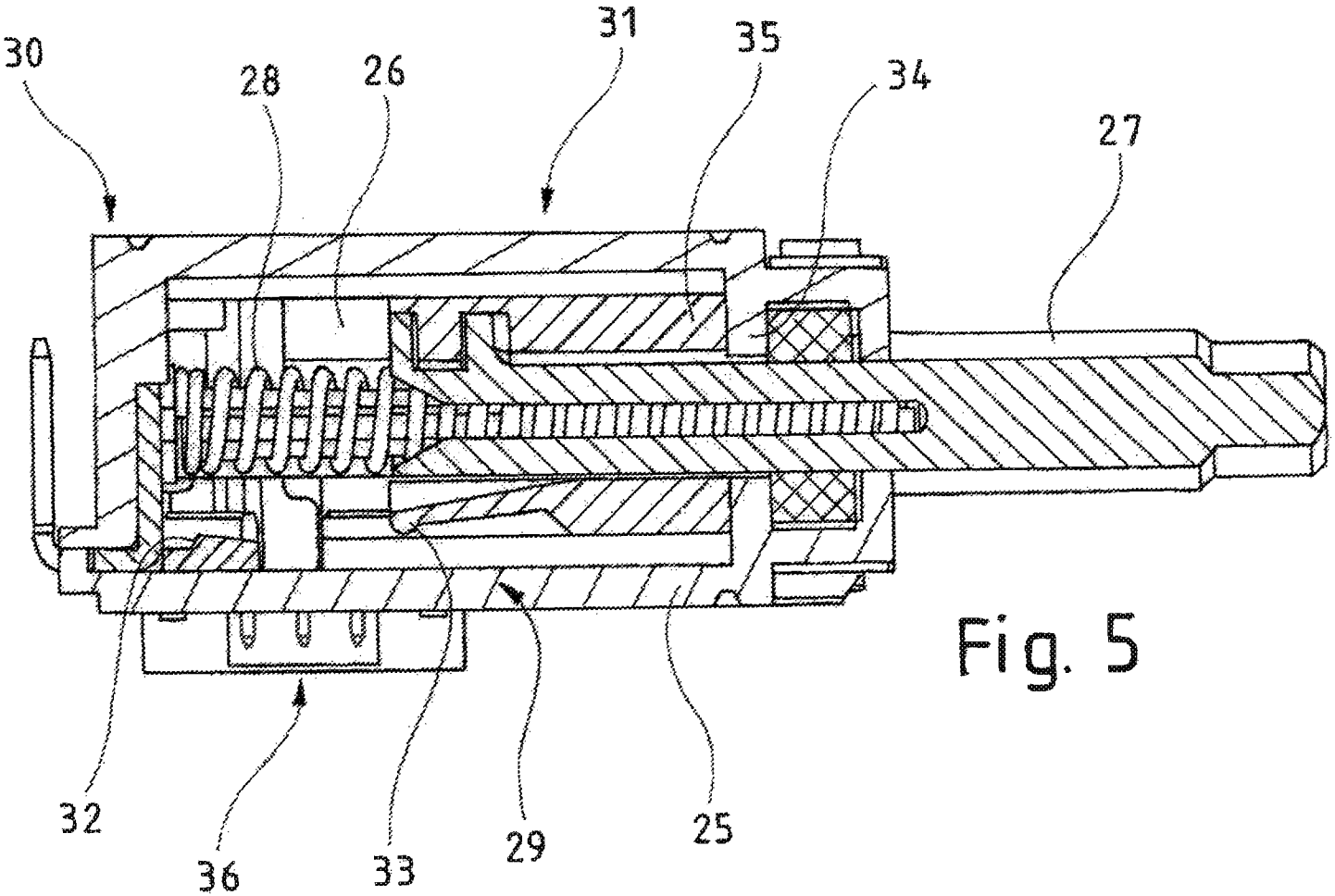
FIG. 5 shows a lengthwise section through a third embodiment of a switch according to the present invention in an unactuated end position of the switch.

FIG. 5 shows the third embodiment of the switch according to the present invention in an unactuated switch end position. An actuating element 27 retained on a travel path 26 and a restoring member 28 that engages with actuating element 27 and again has the form of a helical compression spring are arranged in switch housing 25 of the switch. A resistance generator 29 is attached to actuating element 27 and is held between a counter bearing 30 formed on travel path 26 of switch housing 25 and a floating bearing 31 formed on actuating element 27. The sum of forces in the direction of adjustment member 26 resulting from the restoring force of restoring member 28 and the resistive force of resistance generator 29 is aligned with the restoring force of restoring member 28. Counter bearing 30 of resistance generator 29 is formed on one of the path ends that limit the length of travel path 26. Resistance generator 29 is furnished with a detent structure 32 formed on counter bearing 30 and a detent structure 33 formed on floating bearing 31, wherein the detent structure 33 formed on floating bearing 31 has the form of a resilient detent lug and detent structure 32 formed on counter bearing 30 has the form of a notch that cooperates with the detent lug. Switch housing 25 has an end stop structure 34, which in the switch end position shown lies flush against an end stop structure 35 formed on actuating element 27. An electrical connecting structure 36 that is integrated in switch housing 25 connects the switch according to the invention to an electrical device.

Figure 6:
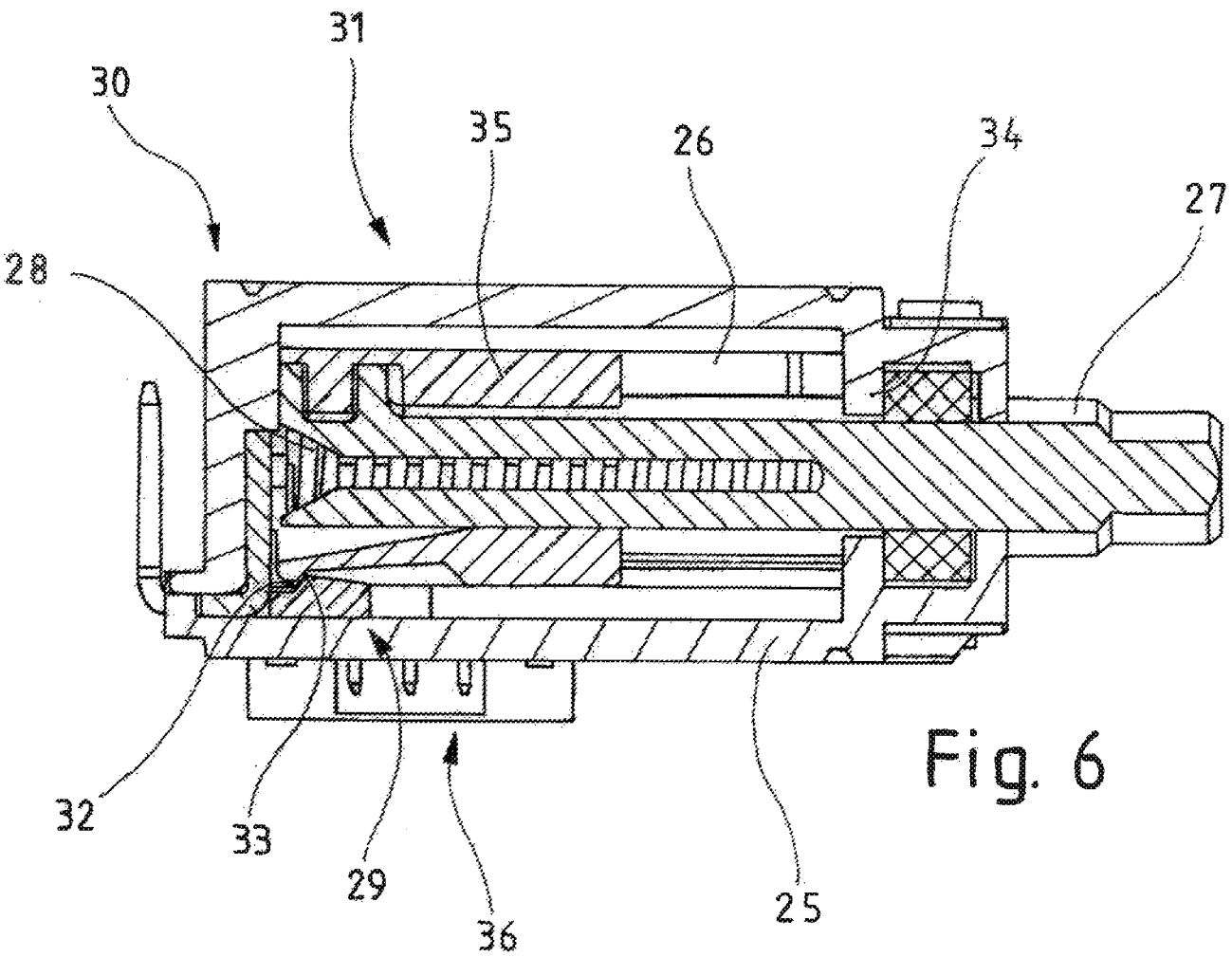
FIG. 6 shows a lengthwise section through the switch of FIG. 5 in an actuated end position of the switch.

FIG. 6 shows the switch according to FIG. 5 in an actuated switch end position, in which detent structure 32 of counter bearing 30 and detent structure 33 of floating bearing 31 are in engaged connection with one another. The same components are identified using the same reference numbers.

Figure 7:
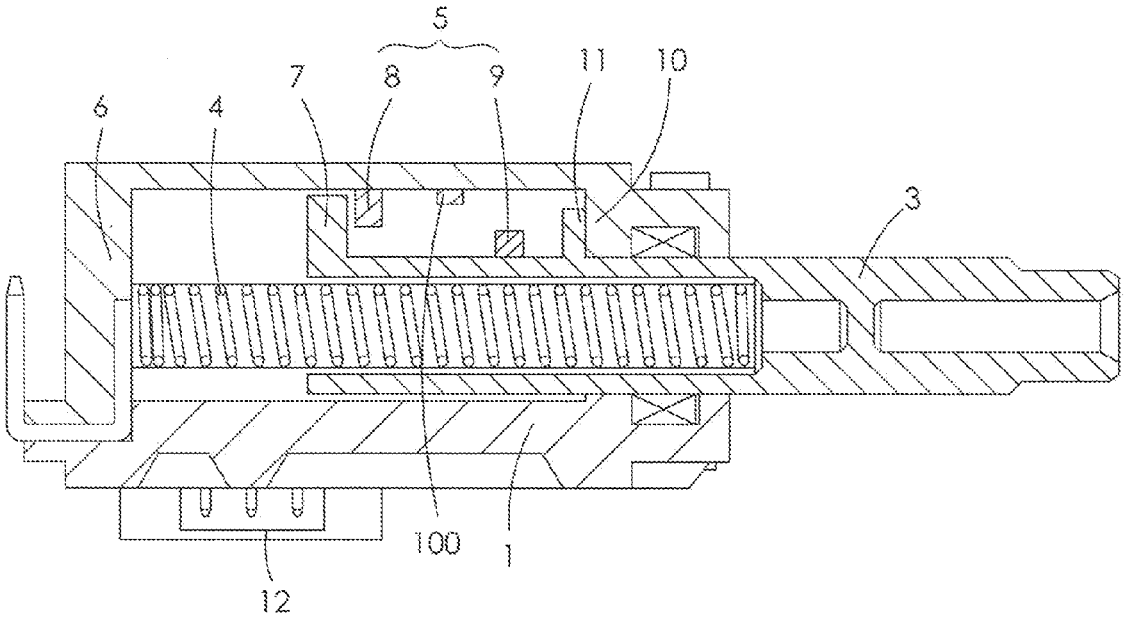
FIG. 7 shows a lengthwise section through a fourth embodiment of a switch according to the present invention in an unactuated end position of the switch.

FIG. 7 shows the fourth embodiment of the switch according to the present invention in an unactuated end position, or off position, of the switch. An actuating element 3 that is retained on a travel path 2 and a restoring member 4 in the form of a helical compression spring that engages with actuating element 3 are arranged inside switch housing 1 of the switch. Resistance generator 5 is formed by two permanent magnets 8, 9. Magnet 8 is attached to a part of the housing, such as the counter bearing 6 and magnet 9 is attached to the actuating element such that they are spaced in a direction perpendicular to the travel path of the actuating element, the vertical direction as viewed, and with their like poles facing towards each other. In the off position of the switch, as shown in FIG. 7, the magnets are separated in the axial direction (path direction) and repel each other such that the magnets urge the slide towards the off position and thus reinforce the restoring force of the spring 4. As the switch is operated the actuating element 3 moves to the left, magnet 9 moves axially towards magnet 8 with the repelling force between the magnets becoming greater and still in a direction which supports the restoring force until magnet 9 is directly aligned with magnet 8. At this position the magnets still repel each other but the repelling force is perpendicular to and thus does not support the restoring force. This position is mechanically unstable and as magnet 9 continues to move axially to the left, the axial component of the repelling force between the magnets changes direction and opposes the restoring force of the spring. Thus the resistance generator reduces the force required to hold the slide in the operated position, as shown in FIG. 8.

FIG. 7 also shows a third magnet 100, which is fixed with respect to the switch housing. The third magnet is arranged with like poles facing the second magnet. The third magnet is arranged to provide a preferred position with a reduced holding force between the off position and the fully actuated position.

Figure 8:
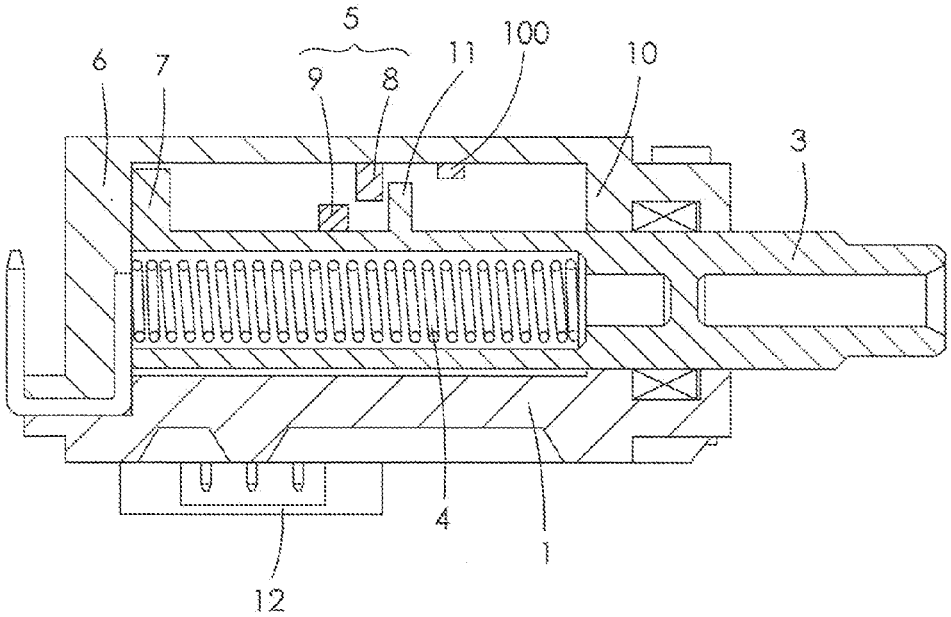
FIG. 8 shows a lengthwise section through the switch of FIG. 7 in an actuated end position of the switch.

FIG. 8 shows the switch according to FIG. 7 in an actuated switch end position, in which magnet 9 of the actuating element is located to the left of magnet 8 of counter bearing 6 and are repelling one another to reduce the restoring force of the restoring element. The same components are identified using the same reference numbers. Additional magnets may be provided to create a number of preferred holding positions of the slide or trigger switch. This is desirable for a switch used with a variable speed motor, for example, in which the speed (or power) of the motor depends on the position of the slide. Please note that the magnets may be attached directly or indirectly to their respective supports.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A switch for an electrical device, comprising:

a switch housing accommodating at least one actuating element retained on a travel path in the switch housing, and movable between an off position at a first end and a second end of the travel path;

at least one restoring member providing a restoring force urging the actuating element to the off position, and a resistance generator attached to the actuating element and retained between at least one resistance bearing formed on the travel path of the switch housing and at least one floating bearing formed on the actuating element, the resistance generator providing a resistive force, wherein the sum of the forces in the direction of the travel path resulting from the restoring force of the restoring member and the resistive force of the resistance generator urging the actuating element to the off position is less when the actuating element is at a selected operational position than when the actuating element is at the off position.

2. The switch of claim 1, wherein the resistance bearing of the resistance generator is formed on at least one of the travel path ends.

3. The switch of claim 1, wherein the resistance bearing of the resistance generator is formed in the middle of the travel section of the travel path.

4. The switch of claim 1, wherein the resistance generator has counter bearings located at several selected points along the travel path.

5. The switch of claim 1, wherein the resistance generator is furnished with ferromagnetic bodies, at least one being arranged on the counter bearing and at least one on the floating bearing, wherein at least one of the ferromagnetic bodies is a magnet.

6. The switch of claim 1, wherein the resistance generator is furnished with ferromagnetic bodies, at least one being arranged on the resistance bearing and at least one on the floating bearing, wherein each of the ferromagnetic bodies is a magnet.

7. The switch of claim 6, wherein the magnets are arranged with their opposite poles facing towards each other.

8. The switch of claim 6, wherein the magnets are arranged with their like poles facing towards each other.

9. The switch of claim 1, wherein the resistance generator has at least one detent structure formed on the resistance bearing and at least one detent structure formed on the floating bearing, wherein at least one of the detent structures comprises a resilient mounting.

10. The switch of claim 1, wherein a first stop structure is formed within the switch housing and is lying against a second stop structure formed on the actuating element.

11. The switch of claim 1, wherein the restoring member is directly arranged between an inner sidewall of the switch housing and an end of the actuating element, the inner sidewall of the switch housing is aligned with the end of the actuating element.

12. The switch of claim 1, wherein the restoring member is in the form of a helical compression spring.

13. The switch of claim 1, wherein the restoring member is arranged inside switch housing.

14. The switch of claim 1, wherein during a process of moving the actuating element from the off position to the selected operational position, the actuating element is pulled by an external force to compress the at least one restoring member until the at least one floating bearing contacts with the at least one resistance bearing.

15. A switch for an electrical device, comprising:

a switch housing;

an actuating element retained on a travel path within the switch housing and movable between an off position and a fully actuated position;

a restoring member providing a restoring force that resiliently urges the actuating element to the off position, and a resistance generator comprising a first magnet fixed with respect to the switch housing and a second magnet fixed with respect to the actuating element, wherein the first magnet and the second magnet are spaced in a direction perpendicular to the travel path with like poles facing towards each other and arranged such that movement of the actuating element from the off position to the fully actuated position causes the second magnet to move past passed the first magnet in the direction of the travel path; and wherein the first magnet and the second magnet are non-overlapped along the travel path.

16. The switch of claim 15, wherein the first and second magnets generate a repulsive force and a component of the repulsive force in the direction of the travel path reinforces the restoring force when the actuating member is in the off position and opposes the restoring force when the actuating member is in the fully actuated position.

17. The switch of claim 15, comprising at least one third magnet, the third magnet being arranged to provide a preferred position having reduced holding force requirement between the off position and the fully actuated position.

18. The switch of claim 17, wherein the third magnet is fixed with respect to the switch housing and is arranged with like poles facing the second magnet.

19. The switch of claim 15, wherein the restoring member is directly arranged between an inner sidewall of the switch housing and an end of the actuating element, the inner sidewall of the switch housing is aligned with the end of the actuating element.

* * * * *